US008857394B2

(12) United States Patent
Toma et al.

(10) Patent No.: US 8,857,394 B2
(45) Date of Patent: Oct. 14, 2014

(54) VARIABLE VALVE TIMING CONTROL APPARATUS

(71) Applicant: Aisin Seiki Kabushiki Kaisha, Kariya (JP)

(72) Inventors: Naoto Toma, Kariya (JP); Shigemitsu Suzuki, Takahama (JP); Hiroki Mukaide, Chiryu (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 0 days.

(21) Appl. No.: 13/902,094

(22) Filed: May 24, 2013

(65) Prior Publication Data

US 2013/0312679 A1 Nov. 28, 2013

(30) Foreign Application Priority Data

May 25, 2012 (JP) ..... 2012-119957

(51) Int. Cl.
*F01L 1/34* (2006.01)
*F02D 13/00* (2006.01)
*F01L 1/344* (2006.01)

(52) U.S. Cl.
CPC ..... *F02D 13/00* (2013.01); *F01L 2001/34479* (2013.01); *F01L 1/3442* (2013.01)
USPC ..... 123/90.17

(58) Field of Classification Search
CPC ..... F01L 2001/34479; F01L 1/3442; F01L 1/344; F01L 1/34; F16K 11/0712
See application file for complete search history.

(56) References Cited

U.S. PATENT DOCUMENTS

2004/0107930 A1* 6/2004 Miura ..... 123/90.17
2009/0243222 A1* 10/2009 Pisseloup ..... 277/422
2011/0114046 A1* 5/2011 Flender et al. ..... 123/90.6
2013/0312680 A1* 11/2013 Kobayashi et al. ..... 123/90.16

FOREIGN PATENT DOCUMENTS

DE 42 21 199 A1 2/1993
JP 2008-275093 A 11/2008

OTHER PUBLICATIONS

Extended European Search Report issued Sep. 12, 2013, by the European Patent Office in corresponding European Patent Application No. 13168991.1. (5 pages).
U.S. Appl. No. 13/667,652, filed Sep. 17, 2012, Aisin Seiki.

* cited by examiner

*Primary Examiner* — Thomas Denion
*Assistant Examiner* — Daniel Bernstein
(74) *Attorney, Agent, or Firm* — Buchanan Ingersoll & Rooney PC

(57) ABSTRACT

A variable valve timing control apparatus includes a driving-side rotating member, an driven-side rotating member, a cam shaft, a control valve switching supply and discharge of a working fluid relative to an advanced angle chamber and a retarded angle chamber, an advanced angle-side oil passage, a retarded angle-side oil passage, a spider provided with a first oil passage and a second oil passage, a seal mechanism partitioning between at least one of the first oil passage and the second oil passage, and an outside space, and the seal mechanism allows air to come in the at least one of the first oil passage and the second oil passage in a case where pressure inside the at least the one of the first oil passage and the second oil passage is lower than air pressure of the outside space.

6 Claims, 5 Drawing Sheets

VARIABLE VALVE TIMING CONTROL APPARATUS

CROSS REFERENCE TO RELATED APPLICATIONS

This application is based on and claims priority under 35 U.S.C. §119 to Japanese Patent Application 2012-119957, filed on May 25, 2012, the entire content of which is incorporated herein by reference.

TECHNICAL FIELD

This disclosure generally relates to a variable valve timing control apparatus.

BACKGROUND DISCUSSION

A known variable valve timing control apparatus, where a relative rotational phase of a driven-side rotating member rotating integrally with a cam shaft of an internal combustion engine relative to a driving-side rotating member rotating synchronously with a crank shaft of the internal combustion engine is controlled, includes a fluid pressure chamber formed between the driving-side rotating member and the driven-side rotating member, and a partition provided for partitioning or separating the fluid pressure chamber into an advanced angle chamber and a retarded angle chamber. According to the known variable valve timing control apparatus, switching between supply and discharge of working fluid relative to the advanced angle chamber or the retarded angle chamber is controlled, and thus the relative rotational phase of the driven-side rotating member relative to the driving-side rotating member is controlled. The above-described technique is disclosed in, for example, JP2008-275093A (hereinafter referred to as Patent reference 1).

A known valve timing changing apparatus (corresponding to the above-described variable valve timing control apparatus) disclosed in Patent reference 1 includes a rotating body (corresponding to the above-described driven-side rotating member) and an outer side rotating body arranged at an outer side (corresponding to the above-described driving-side rotating member) which are arranged coaxially with each other, and two fluid pressure chambers which are supplied with working fluid via respective two fluid pressure passages. The valve timing changing apparatus changes a relative rotational position of the rotating body and the outer side rotating body relative to each other on the basis of fluid pressure of the two fluid pressure chambers, and thereby changing a valve timing of a intake valve or an exhaust valve of an internal combustion engine. According to the known valve timing changing apparatus disclosed in Patent reference 1, the rotating body is arranged at an outer periphery of a substantially column-shaped body axis to be coaxially with the body axis. The two fluid pressure passages are connected via respective inner passages of the body axis to respective annular passages formed between the body axis and the rotating body. Further, seal rings partitioning the respective annular passages of the two fluid pressure passages are disposed between the axis body and the rotating body, and ring grooves each of which is recessed to have a substantially rectangular cross section are formed at an outer circumferential surface of the body axis or an inner circumferential surface of the rotating body. The seal rings are arranged at the respective ring grooves in a manner that each of the seal rings enters the corresponding ring groove.

According to some of the variable valve timing control apparatuses, before a start-up of the internal combustion engine, the relative rotational phase of the rotating body and the outer side rotating body relative to each other is fixed at an intermediate position between a most retarded angle and a most advanced angle before a start-up of the internal combustion engine, and the relative rotational phase is controlled to move to the most retarded angle-side or the most advanced angle-side after the start-up of the internal combustion engine. However, the intake valve or the exhaust valve of the internal combustion engine of which relative rotational phase is controlled by the variable valve timing control apparatus is pressed downwardly (or pressed upwardly) against a valve spring, and therefore an intake timing or an exhaust timing may possibly delay relative to a desired or intended timing. In this case, an operation of the internal combustion engine may deviate from a desired or intended operation. Thus, after the start-up of the internal combustion engine, it is required that the relative rotational phase be controlled to move quickly from the intermediate position to the most retarded angle-side or to the most advanced angle-side.

For example, the technique described in Patent reference 1 may be applied to the above-described variable valve timing control apparatus. The variable valve timing control apparatus is configured so that the supply and the discharge of the working fluid are conducted, and that a pump provided at a supply path of the working fluid of the variable valve timing control apparatus pumps up the working fluid from an oil pan. Accordingly, depending on a flow path resistance of the supply path, the working fluid may not be supplied to the variable valve timing control apparatus immediately after the pump starts. On the other hand, a discharge path of the working fluid of the variable valve timing control apparatus is configured so that the working fluid returns to the oil pan freely without intervention of, for example, the pump. Thus, according to the configuration of the variable valve timing control apparatus, the flow path resistance at the discharge path is set to be relatively low, and thus the working fluid is discharged easily (that is, a drainage performance is high). Because of the above-described configuration where imbalance exists between the flow path resistance at the supply path and the flow path resistance at the discharge path, the working fluid may not be supplied smoothly to one of the advanced angle chamber and the retarded angle chamber in order to move the relative rotational phase from the intermediate position to the most retarded angle-side or to the most advanced angle-side. In this case, it is difficult to move the relative rotational phase of the rotating body relative to the outer side rotating body to the desired or intended relative rotational phase, and therefore it may take time for transition to the desired rotational phase to take place. Consequently, the operation of the internal combustion engine may deviate from the desired or intended operation.

A need thus exists for a variable valve timing control apparatus which is not susceptible to the drawback mentioned above.

SUMMARY

According to an aspect of this disclosure, the variable valve timing control apparatus includes a driving-side rotating member rotating synchronously with a crank shaft of an internal combustion engine, a driven-side rotating member rotating integrally with a cam shaft of the internal combustion engine and being rotatable relative to the driving-side rotating member, a control valve operating for switching supply and discharge of a working fluid in a selective manner relative to an advanced angle chamber and a retarded angle chamber which are provided between the driving-side rotating member and the driven-side rotating member, an advanced angle-side oil passage providing fluid communication between the control valve and the advanced angle chamber, a retarded angle-side oil passage providing fluid communication between the control valve and the retarded angle chamber, a spider arranged coaxially with the cam shaft and provided with a first oil passage and a second oil passage which is different from the first oil passage, a part of the advanced angle-side oil passage functioning as the first oil passage, a part of the retarded angle-side oil passage functioning as the second oil passage, a seal mechanism partitioning between at least one of the first oil passage and the second oil passage, and an outside space, and the seal mechanism allowing air to come in the at least one of the first oil passage and the second oil passage in a case where pressure inside the at least the one of the first oil passage and the second oil passage is lower than air pressure of the outside space.

According to an aspect of this disclosure, a variable valve timing control apparatus includes a driving-side rotating member rotating synchronously with a crank shaft of an internal combustion engine, an driven-side rotating member rotating integrally with a cam shaft of the internal combustion engine and being rotatable relative to the driving-side rotating member, a control valve operating for switching supply and discharge of a working fluid in a selective manner relative to an advanced angle chamber and a retarded angle chamber which are provided between the driving-side rotating member and the driven-side rotating member, an advanced angle-side oil passage providing fluid communication between the control valve and the advanced angle chamber, a retarded angle-side oil passage providing fluid communication between the control valve and the retarded angle chamber, a spider arranged coaxially with the cam shaft, and provided with a first oil passage and a second oil passage which is different from the first oil passage, the spider provided with a plurality of wall portions each extending in a direction that is orthogonal to an axis of the cam shaft, a part of the advanced angle-side oil passage functioning as the first oil passage and a part of the retarded angle-side oil passage functioning as the second oil passage, a seal mechanism including an annular groove defined by the plurality of wall portions and an outer circumferential surface of the spider, the seal mechanism including a seal ring at least part of which is fitted in the annular groove, the seal mechanism partitioning between at least one of the first oil passage and the second oil passage, and an outside space, the seal ring including a first end surface facing in an opposite direction to the outside space and a second end surface facing in a direction of the outside space, and the first end surface of the seal ring coming in contact with one of the plurality of wall portions which faces in the direction of the outside space in a case where pressure of said at least one of the first oil passage and the second oil passage is lower than air pressure of the outside space, the second end surface of the seal ring coming in contact with one of the plurality of wall portions which faces in the opposite direction to the outside space in a case where the pressure of said at least one of the first oil passage and the second oil passage is higher than the air pressure of the outside space.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

An embodiment of this disclosure will be explained in detail. A variable valve timing control apparatus 100 according to this embodiment is configured to improve responsiveness immediately after an internal combustion engine starts. The variable valve timing control apparatus 100 will be explained with reference to the drawings.

Figure 1:
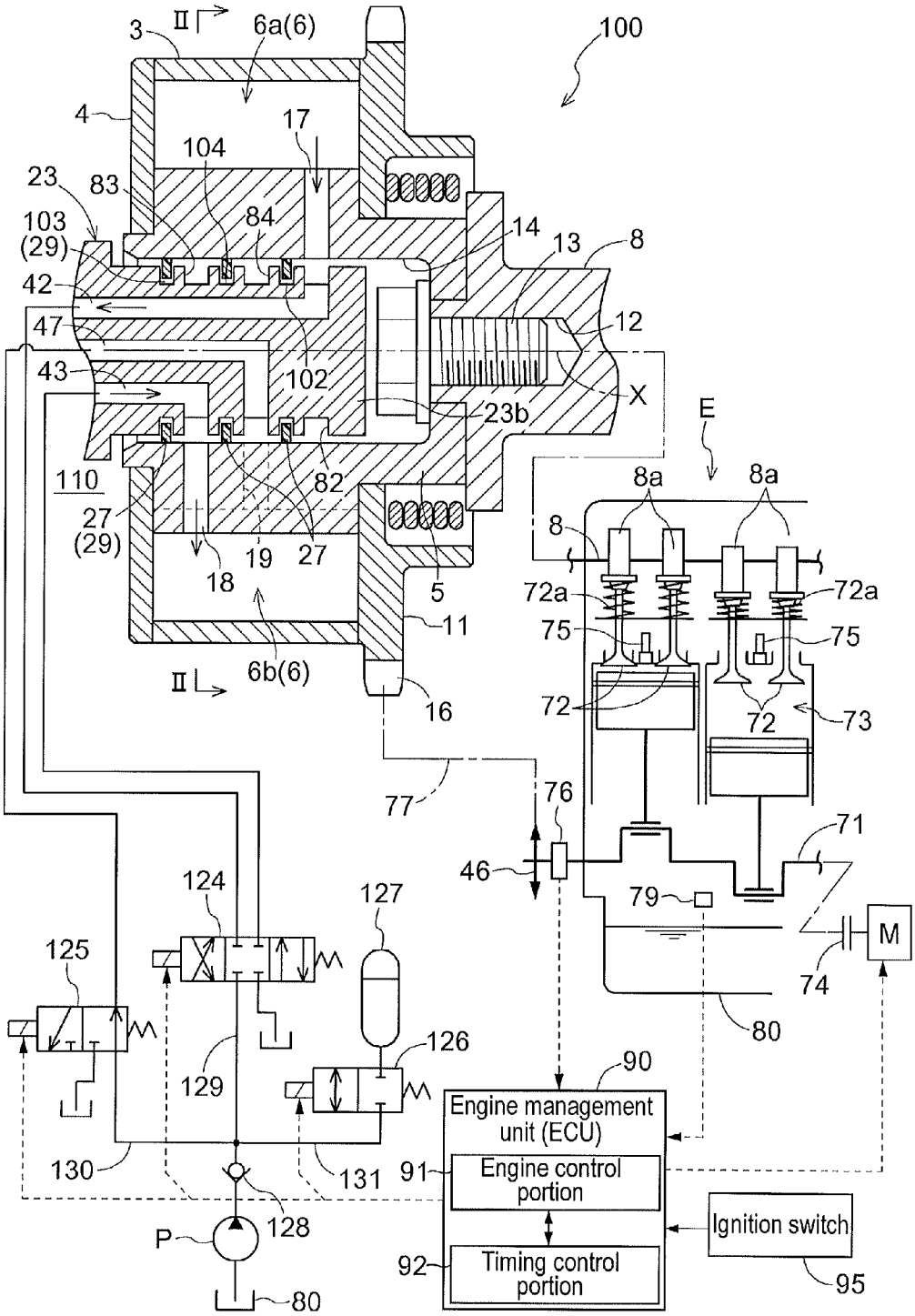
FIG. 1 is a cross-sectional view of a variable valve timing control apparatus according to an embodiment disclosed here.

As illustrated in FIG. 1, the variable valve timing control apparatus 100 includes an outer rotor 3 (i.e., a driving-side rotating member) and a front plate 4 both of which rotate synchronously with a crank shaft 71 of an engine E (i.e., an internal combustion engine), and a inner rotor 5 (i.e., a driven-side rotating member) which rotates coaxially and integrally with a cam shaft 8 for opening/closing an intake valve 72 of a combustion chamber 73 of the engine E. The variable valve timing control apparatus 100 is configured by a combination of the above-described members so that the inner rotor 5 is rotatable about an axis X of the cam shaft 8 relative to the outer rotor 3 and to the front plate 4. According to this embodiment, the variable valve timing control apparatus 100 controls an open/close timing of the intake valve 72 by means of a setting of a relative rotational phase (a relative rotation angle) of rotation of the inner rotor 5 and the outer rotor 3 about the axis X relative to each other.

The inner rotor 5 is integrally mounted on a distal end of the cam shaft 8 that constitutes the rotational shaft of a cam 8*a* controlling opening/closing of the intake valve 72 of the engine E. The inner rotor 5 includes a recessed portion 14 at an inner side in a radial direction of the inner rotor 5. At the distal end of the cam shaft 8, a fixing hole 12 is provided so as to face or oppose the recessed portion 14. A bolt 13 is inserted in the fixing hole 12, thereby fixedly fastening the inner rotor 5 to the cam shaft 8. The cam shaft 8 is rotatably assembled on a cylinder head of the engine E.

The engine E is an Atkinson cycle engine and is mounted on a hybrid-type vehicle including a hybrid-type drive mechanism. The hybrid-type drive mechanisms include a series type and/or a series-parallel type. The intake valve 72 is biased by a valve spring 72*a* in a closing direction. The intake valve 72 is switched by the cam 8*a* between an open position where the intake valve 72 moves in a press-down direction to be opened, and a close position where the intake valve 72 is closed by a biasing force of the valve spring 72*a*.

An electric motor M is connected via a main clutch 74 to the crank shaft 71. The engine E, including the electric motor M, is managed by an engine management unit 90 configured as an ECU. The engine management unit 90 manages, for example, an intake system, a fuel supply system, an ignition spark timing of an ignition plug 75, start-up of the engine by the electric motor M and stop of the engine E.

The engine management unit 90 includes an engine control portion 91 configured by software and a timing control portion 92 constituted by software. The engine control portion 91 performs an automatic start and an automatic stop of the engine E. The timing control portion 92 controls an amount of intake air of the engine E by controlling the variable valve timing control apparatus 100.

The electric motor M functions as a starter motor and as a generator. The electric motor M, as the starter motor, drives the crank shaft 71 to rotate by means of electric power from a battery in response to an operation of an ignition switch 95, so that the engine E starts. The electric motor M, as the generator, generates electric power by means of a driving force from the crank shaft 71. The electric power generated by the electric motor M is charged in the battery.

At the vehicle provided with the hybrid-type drive mechanism, the automatic start-up and the automatic stop of the engine E take place frequently. When the automatic stop is performed by the engine management unit 90, the variable valve timing control apparatus 100 illustrated in FIG. 1 controls the relative rotation angle to be set at a most retarded angle so that the automatic start-up at the next time is performed with a small load imposed on the electric motor M. Further, at a system stop, the variable valve timing control apparatus 100 controls the relative rotation angle to be set at a lock angle in order to achieve a stable start-up of the engine E at the next time.

The outer rotor 3 and the inner rotor 5 are arranged to be coaxial with the axis X. The inner rotor 5 is fitted inside the outer rotor 3, and the inner rotor 5 and the outer rotor 3 are configured to be sandwiched between the front plate 4 and a rear plate 11. The front plate 4 and the rear plate 11 are connected to the outer rotor 3 by means of a connecting bolt 15, for example, by plural connecting bolts 15. A timing sprocket 16 is provided at an outer circumference of the rear plate 11. The inner rotor 5 and the rear plate 11 are arranged coaxially with each other, and the inner rotor 5 and the cam shaft 8 are securely connected to each other with the bolt 13.

A power transmission member 77 including, for example, a timing chain and/or a timing belt, is provided so as to extend between an output sprocket 46 provided at the crank shaft 71 of the engine E and the timing sprocket 16. Thus, when the crank shaft 71 is driven to rotate, the rotative power is transmitted via the power transmission member 77 to the timing sprocket 16, and therefore the outer rotor 3 is driven to rotate. As the outer rotor 3 is driven to rotate, the inner rotor 5 is driven to rotate and the cam shaft 8 rotates. Further, the cam 8*a* provided at the cam shaft 8 presses down the intake valve 72 of the engine E so that the intake valve 72 opens.

Figure 2:
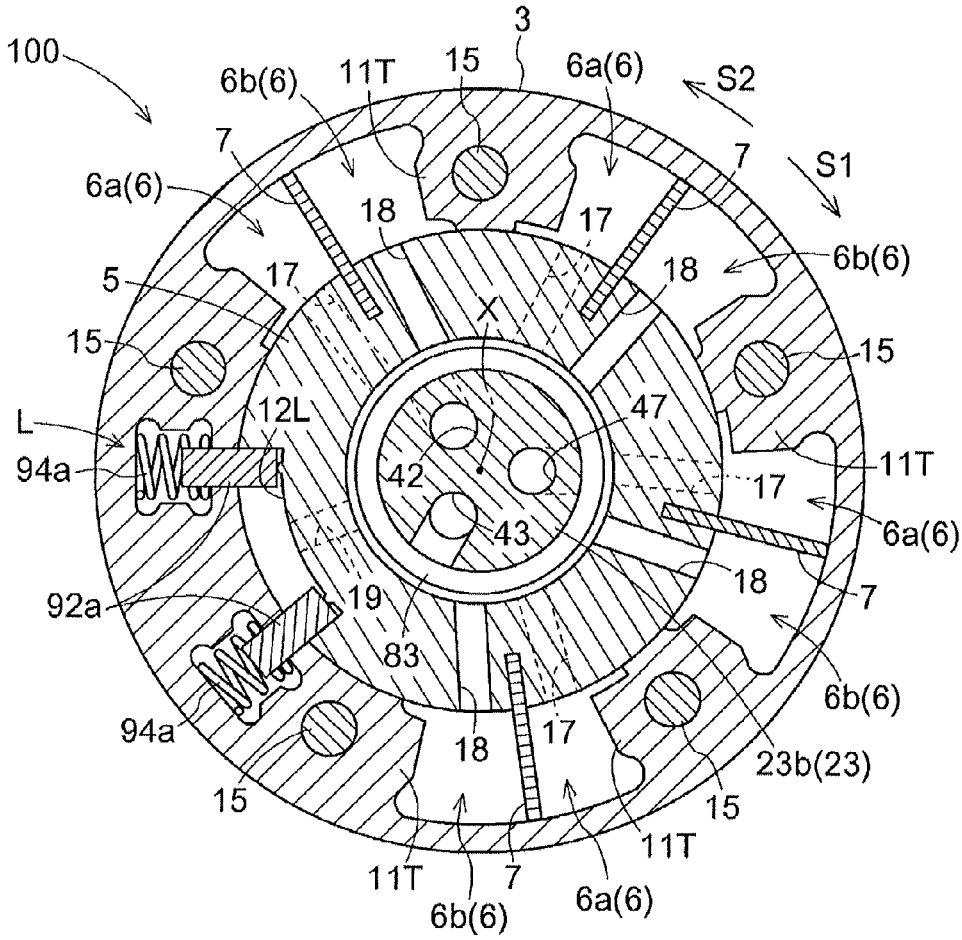
FIG. 2 is a cross-sectional view taken along line II-II in FIG. 1.

As illustrated in FIG. 2, the outer rotor 3 is provided with plural protruding portions 11T each protruding toward the inner side in the radial direction so that a fluid pressure chamber 6 is formed or defined between the adjacent protruding portions 11T in a rotational direction. In this embodiment, four of the fluid pressure chambers 6 are provided. The inner rotor 5 is formed in a cylindrical shape having an outer periphery that is closely in contact with the plural protruding portions 11T. The inner rotor 5 includes plural vanes 7 each of which is fitted in the corresponding fluid pressure chamber 6 and each of which partitions the corresponding fluid pressure chamber 6 into two spaces in the rotational direction. Each of the fluid pressure chambers 6 is partitioned or divided by the corresponding vane 7 into an advanced angle chamber 6*a* and a retarded angle chamber 6*b* in a relative rotational direction (a direction of an arrow S1 and a direction of an arrow S2 in FIG. 2).

As illustrated in FIG. 2, the advanced angle chamber 6*a* and the retarded angle chamber 6*b* are formed between the inner rotor 5 and the outer rotor 3. Further, the inner rotor 5 is provided with an advanced angle chamber communication hole 17 and a retarded angle chamber communication hole 18. The advanced angle chamber communication hole 17 provides fluid communication between the recessed portion 14 formed in a cylindrical configuration and the advanced angle chamber 6*a*. The retarded angle chamber communication hole 18 provides fluid communication between the recessed portion 14 and the retarded angle chamber 6*b*.

As illustrated in FIG. 2, when working fluid from a pump P (refer to FIG. 1) is supplied to the advanced angle chamber 6*a* and working fluid in the retarded angle chamber 6*b* is discharged, the relative rotational phase of the inner rotor 5 and the outer rotor 3 relative to each other is displaced in an advanced angle direction S1. On the other hand, when working fluid in the advanced angle chamber 6*a* is discharged and the working fluid from the pump P is supplied to the retarded angle chamber 6*b*, the relative rotational phase of the inner rotor 5 and the outer rotor 3 relative to each other is displaced in a retarded angle direction S2. The advanced angle direction S1 refers to a direction in which the vane 7 is displaced relative to the outer rotor 3, that is, the clockwise direction in FIG. 2, and the retarded angle direction S2 refers to a direction in which the vane 7 is displaced relative to the outer rotor 3, that is, the counterclockwise direction in FIG. 2. A relationship between the crank shaft 71 and the cam shaft 8 is set so that an intake air compression ratio increases as an amount of change of the relative phase increases when the relative rotational phase changes in the advanced angle direction S1, and so that the intake air compression ratio decreases as the amount of change of the relative phase increases when the relative rotational phase changes in the retarded angle direction S2.

The relative rotation angle in a state where the vane 7 reaches a movable end (that is, an end in the rotation of the vane 7 about the axis X) in the advanced angle direction S1 is referred to as a most advanced angle, and the relative rotation angle in a state where the vane 7 reaches a movable end (that is, an end in the rotation of the vane 7 about the axis X) at a retarded angle-side is referred to as a most retarded angle. The variable valve timing control apparatus 100 is configured so that the relative rotation angle may be set in a control area between the most advanced angle and the most retarded angle. In concept, the most advanced angle refers to not only the movable end of the vane 7 in the advanced angle direction S1 but also a vicinity thereof. Similarly, in concept, the most retarded angle refers to not only the movable end of the vane 7 in the retarded angle direction S2 but also a vicinity thereof.

The variable valve timing control apparatus 100 according to this embodiment includes an intermediate lock mechanism L for restraining or locking the relative rotation angle of the outer rotor 3 and the inner rotor 5 relative to each other at the lock angle between the most advanced angle and the most retarded angle (in the control area). The intermediate lock mechanism L includes a pair of lock members 92*a*, lock springs 94*a* and a lock groove portion 12L. Each of the pair of lock members 92*a* is configured to protrude and recess relative to the outer rotor 3 in a posture in which each of the lock members 92*a* is orthogonal to the axis X, so that a protruding end of the lock member 92*a* comes closer to and away from the axis X. Each of the lock springs 94*a* biases the corresponding lock member 92*a* in a protruding direction thereof. The lock groove portion 12L is provided at the outer periphery of the inner rotor 5 so that the lock members 92*a* are inserted into and come out of the lock groove portion 12L.

According to the intermediate lock mechanism L, the relative rotation angle of the outer rotor 3 and the inner rotor 5 relative to each other is locked at the lock angle in a manner that the pair of lock members 92*a* are engaged in the lock groove portion 12L by insertion at the same time with each other. Thus, the engine starts up appropriately even when an engine temperature is low. Further, the intake air compression ratio that allows the engine E to operate efficiently at a low fuel consumption is set. The configuration of the intermediate lock mechanism L is not limited thereto, and the lock member slidably moving in a posture in which the lock member is parallel to the axis X may be provided at the inner rotor 5, and a recessed portion which the lock member engages with and disengages from may be provided at the front plate 4 or the rear plate 11, for example.

The advanced angle chamber communication hole 17 having the fluid communication with the advanced angle chamber 6*a*, the retarded angle chamber communication hole 18 having the fluid communication with the retarded angle chamber 6*b* and an unlocking oil passage 19 having fluid communication with the lock groove portion 12L are provided at the inner rotor 5. An advanced angle control groove 82 (i.e., a first oil passage) is provided so as to have fluid communication with the advanced angle chamber communication hole 17, a retarded angle control groove 83 (i.e., a second oil passage) is provided so as to have fluid communication with the retarded angle chamber communication hole 18 and a lock control groove 84 is provided so as to have fluid communication with the unlocking oil passage 19. Each of the advanced angle control groove 82, the retarded angle control groove 83 and the lock control groove 84 is formed in an annular configuration.

As illustrated in FIG. 1, the engine E is provided with the pump P for pumping up oil in an oil pan 80 and for pumping out or transmitting the oil as the working fluid, by means of the driving force of the engine E. The variable valve timing control apparatus 100 is provided with a relative rotation angle control valve 124 (i.e., a control valve) which is a solenoid-operated type valve, a lock control valve 125 which is a solenoid-operated type valve, an pressure accumulation control valve 126 which is a solenoid-operated type valve, an accumulator 127 and the engine management unit 90 controlling or managing these three valves (mainly, the control of the timing control portion 92).

At an oil supply passage of the pump P, a check valve 128 allowing a flow of the working fluid pumped out from the pump P and blocking a flow of the working oil in a direction of the pump P. An oil passage system is established, where the working fluid transmitted from the check valve 128 is branched into and pumped out to a rotation angle control oil passage 129, a lock control oil passage 130 and an oil connection passage 131. The rotation angle control oil passage 129 is connected to the relative rotation angle control valve 124, the lock control oil passage 130 is connected to the lock control valve 125 and the oil connection passage 131 is connected to the pressure accumulation control valve 126. Further, the relative rotation angle control valve 124 is connected to the advanced angle control groove 82 and to the retarded angle control groove 83, and the lock control valve 125 is connected to the lock control groove 84.

The relative rotation angle control valve 124 is configured to be operable at an advanced angle position, a retarded angle position and a neutral position. At the advanced angle position, the relative rotation angle control valve 124 supplies the working fluid of the pump P to the advanced angle chamber 6*a* through an advanced angle-side oil passage 42 and discharges the working fluid in the retarded angle chamber 6*b* through a retarded angle-side oil passage 43. At the retarded angle position, the relative rotation angle control valve 124 supplies the working fluid of the pump P to the retarded angle chamber 6*b* through the retarded angle-side oil passage 43 and discharges the working fluid in the advanced angle chamber 6*a* through the advanced angle-side oil passage 42. At the neutral position, the relative rotation angle control valve 124 does not supply the working fluid either to the advanced angle chamber 6*a* or to the retarded angle chamber 6*b*.

The lock control valve 125 is configured to be operable at an unlock position and a lock position. At the unlock position, the lock control valve 125 supplies the working fluid of the pump P to the lock groove portion 12L via the unlocking oil passage 19, thereby releasing the lock. At the lock position, the lock control valve 125 discharges the working fluid out of the lock groove portion 12L, thereby allowing the lock. The pressure accumulation control valve 126 is configured to be operable at an open position at which the working fluid of the pump P is supplied to the accumulator 127 (that is, the supply/discharge is allowed) and a close position at which supply of the working fluid from the pump P to the accumulator 127 is blocked (that is, the supply/discharge is disabled).

A signal system includes the ignition switch 95 for starting the engine E, a crank shaft sensor 76 configured to measure a rotation angle and a rotation speed of the crank shaft 71 of the engine E and an engine temperature sensor 79 for measuring the temperature of the engine E on the basis of temperature of coolant water of the engine E. At the signal system, signals from the ignition switch 95, the crank shaft sensor 76 and the engine temperature sensor 79 are inputted to the engine management unit 90. Further another signal system is established, where control signals are outputted from the engine management unit 90 to the electric motor M, to an ignition circuit for actuating the ignition plug 75 and to a throttle control circuit. Further, another signal system is established, where control signals are outputted to the relative rotation angle control valve 124, to the lock control valve 125 and to the pressure accumulation control valve 126. Signals from, for example, an acceleration sensor measuring an operation amount of an accelerator pedal and/or from a running speed sensor are inputted to the engine management unit 90.

The ignition switch 95 is configured as a switch for starting up a system, that is, an electric system of the vehicle. When the ignition switch 95 is operated to be ON, the system is activated and a system activation state is established where electric power is supplied to the electric system and the automatic start and the automatic stop of the engine E are allowed. When the ignition switch 95 is operated to be OFF, the system stops. When the ignition switch 95 is operated to be OFF in a case where the engine E is in an operation state, the engine E stops. Specifically, a signal obtained when the ignition switch 95 is turned ON is referred to as a system start-up trigger. As the ignition switch 95, a switch that is actuated by a pressing operation is assumed, that is, a first pressing operation functions as an ON operation and the next pressing operation functions as an OFF operation, however, the ignition switch 95 may be a switch that is operated by rotating by use of a key. Alternatively, the ignition switch 95 may be configured so that the ON operation and the OFF operation are performed with switches that are provided separately from each other.

Because the electric motor M functions as the starter motor and as the generator as described above, in a case where the battery voltage decreases when the engine E is stopped (that is, in a case where a start condition is fulfilled), an automatic start-up trigger is generated and the engine management unit 90 causes the engine E to be started by a driving of the electric motor M, and causes the battery to be charged. In a case where the battery is charged and thus the battery voltage increases up to a predetermined voltage (that is, in a case where a stop condition is fulfilled), an automatic stop trigger is generated and the engine management unit 90 controls the engine E to stop.

The relative rotation angle control valve 124 serves as the control valve, and operates for switching supply and discharge of the working fluid in a selective manner relative to the advanced angle chamber 6*a* and the retarded angle chamber 6*b*. That is, the relative rotation angle control valve 124 discharges the working fluid from the retarded angle chamber 6*b* when supplying the working fluid to the advanced angle chamber 6*a*, and the relative rotation angle control valve 124 discharges the working fluid from the advanced angle chamber 6*a* when supplying the working fluid to the retarded angle chamber 6*b*.

A housing 23 is arranged at a front end of the variable valve timing control apparatus 100 and includes a spider 23*b* formed in a protruding shape. The spider 23*b* includes a cylindrical configuration that corresponds to a configuration of the recessed portion 14 of the inner rotor 5 and is arranged coaxially with the cam shaft 8. The spider 23*b* is arranged so that a predetermined clearance is provided between an inner circumferential surface of the recessed portion 14 and an outer circumferential surface of the spider 23*b*. According to the example illustrated in FIG. 1, fluid communication is provided between the relative rotation angle control valve 124 and the advanced angle chamber 6*a* by means of the advanced angle-side oil passage 42. On the other hand, fluid communication is provided between the relative rotation angle control valve 124 and the retarded angle chamber 6*b* by means of the retarded angle-side oil passage 43.

The spider 23*b* is arranged inside the recessed portion 14 of the inner rotor 5 by insertion so as to be rotatable relative to the inner rotor 5 and the housing 23 is fixed at, for example, a front cover of the engine E. Thus, the inner rotor 5 is supported by the spider 23*b* so as to be rotatable relative to the spider 23*b*. The spider 23*b* is provided with the advanced angle control groove 82 and the retarded angle control groove 83. In this embodiment, annular grooves 102, 103 and 104 are provided at the outer circumferential surface of the spider 23*b*. The annular grooves 102, 103 and 104 are arranged to be coaxial with the cam shaft 8 in a similar manner to that the spider 23*b* is coaxially arranged with the cam shaft 8. The annular grooves 102, 103 and 104 are arranged on the outer circumferential surface of the spider 23*b* to be offset from one another in a protruding direction. A seal ring 27 is provided at each of the annular grooves 102, 103 and 104. Accordingly, the advanced angle control groove 82 is defined by an enclosed space enclosed by the inner circumferential surface of the recessed portion 14, the outer circumferential surface of the spider 23*b* and the seal ring 27 provided at the annular groove 102, and the advanced angle control groove 82 constitutes a part of the advanced angle-side oil passage 42. On the other hand, the retarded angle control groove 83 is defined by an enclosed space enclosed by the inner circumferential surface of the recessed portion 14, the outer circumferential surface of the spider 23*b*, the seal ring 27 provided at the annular groove 103 and the seal ring 27 provided at the annular groove 104, and the retarded angle control groove 83 constitutes a part of the retarded angle-side oil passage 43. The part of the advanced angle-side oil passage 42 functions as the advanced angle control groove 82 and the part of the retarded angle-side oil passage 43 functions as the retarded angle control groove 83.

The seal ring 27, which is for preventing the working fluid from leaking, is provided at each of the annular grooves 102, 103 and 104 in a manner that at least a part of each of the seal rings 27, for example, a radially inner end portion of the seal ring 27, fits in (that is, accommodated in) the corresponding annular groove 102, 103 or 104, and in a manner that a radially outer end portion of each of the seal ring 27 is in contact with the inner circumferential surface of the recessed portion 14 according to this embodiment. In this embodiment, the annular groove 103 and the seal ring 27 arranged at the annular groove 103 constitute a seal mechanism 29. Accordingly, the retarded angle control groove 83 is partitioned or separated from an outside space 110 by the seal mechanism 29. The outside space 110 refers to the space which is at an outer side relative to the outer rotor 3 and the front plate 4, and is under an environment of an atmospheric pressure.

As illustrated in FIG. 1, a lock-side oil passage 47, as well as the advanced angle-side oil passage 42 and the retarded angle-side oil passage 43, is provided inside the spider 23*b* to extend in an extending direction of the spider 23*b*, that is, in an extending direction of the cam shaft 8. One end of the advanced angle-side oil passage 42 is in fluid communication with the relative rotation angle control valve 124 and the other one end thereof opens to the advanced angle control groove 82. One end of the retarded angle-side oil passage 43 is in fluid communication with the relative rotation angle control valve 124 and the other one end thereof opens to the retarded angle control groove 83. One end of the lock-side oil passage 47 is in fluid communication with the lock control valve 125 and the other one end thereof opens to the lock control groove 84.

At the start-up of the engine E, the relative rotational angle of the outer rotor 3 and the inner rotor 5 relative to each other is locked at the lock angle in a manner that the pair of lock members 92*a* are engaged in the lock groove portion 12L by insertion at the same time with each other as described above. After this, the lock control valve 125 and the pressure accumulation control valve 126, each of which is the solenoid-operated type valve, are controlled by the timing control portion 92, and the working fluid that is accumulated in the accumulator 127 in a pressurized state is supplied to the lock-side oil passage 47. Thus, the lock members 92*a* are pushed out of the lock groove portion 12L against the biasing force of the lock springs 94*a*.

Immediately after the engine E starts, the relative rotational phase of the outer rotor 3 and the inner rotor 5 relative to each other is arranged at a most retarded angle-side. Accordingly, the working fluid is supplied from the pump P via the relative rotation angle control valve 124 to the retarded angle-side oil passage 43. As a result, the working fluid is supplied to the retarded angle chamber 6*b*, and therefore the inner rotor 5 rotates relative to the outer rotor 3 in the retarded angle direction S2.

Accordingly, the rotative power of the crank shaft 71, which is transmitted via the power transmission member 77, is rotated relative to the cam shaft 8 in the retarded angle direction S2 and is transmitted to the cam shaft 8. In accordance with the relative rotational phase that is arranged as described above, the cam shaft 8 presses down the intake valve 72 against the valve spring 72*a* attached to the intake valve 72. At this time, the relative rotational phase that is arranged by the variable valve timing control apparatus 100 may possibly be deviated from a desired or intended phase due to a cam torque depending on a positional relationship between the intake valve 72 and the cam 8*a*. Thus, according to the variable valve timing control apparatus 100 of this embodiment, the seal mechanism 29 is configured so that the relative rotational phase moves to the most retarded angle quickly.

Figure 3:
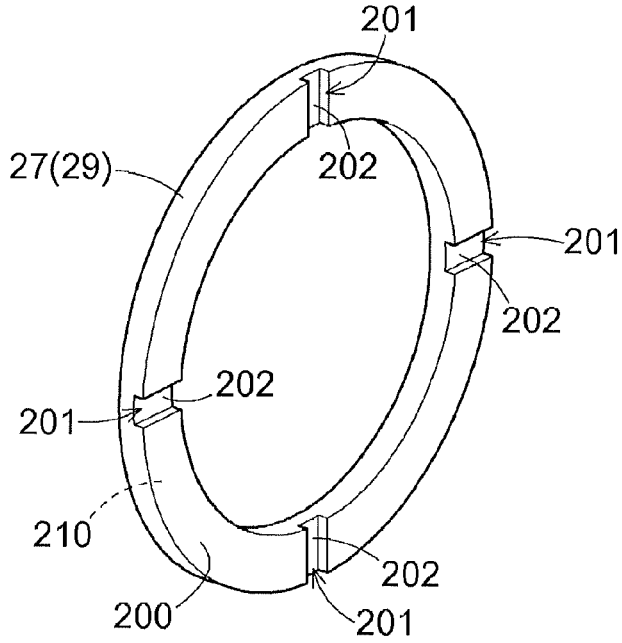
FIG. 3 is a perspective view of a seal ring provided with a radial direction groove according to the embodiment.

The seal mechanism 29 allows air to come into the retarded angle control groove 83 in a case where pressure of the retarded angle control groove 83, that is, the pressure inside the retarded angle control groove 83, is lower than air pressure of the outside space 110. In this embodiment, as illustrated in FIG. 3, the seal ring 27 constituting the seal mechanism 29 is provided with a radial direction groove 201 that is formed at an axial direction end surface 200 of the seal ring 27 which faces in an opposite direction to the outside space 110. The radial direction groove 201 is formed so as to extend from an inner circumferential surface through an outer circumferential surface of the seal ring 27 in the radial direction thereof. Further, the radial direction groove 201 is configured to include at least a bottom portion 202. On the other hand, an axial direction end surface 210 of the seal ring 27 which faces in a direction of the outside space 110 is not provided with the radial direction groove 201 and is formed in a substantially flat configuration. Thus, the axial direction end surface 210 faces the outside space 110 and the axial direction end surface 200 is positioned at an opposite side of the seal ring 27 in the axial direction thereof relative to the axial direction end surface 210. The axial direction end surface 200 serves as a first end surface and the axial direction end surface 210 serves as a second end surface. The seal ring 27 is made of, for example, a fluorine-based material (including, for example, a fluorine-based resin material).

Figure 4:
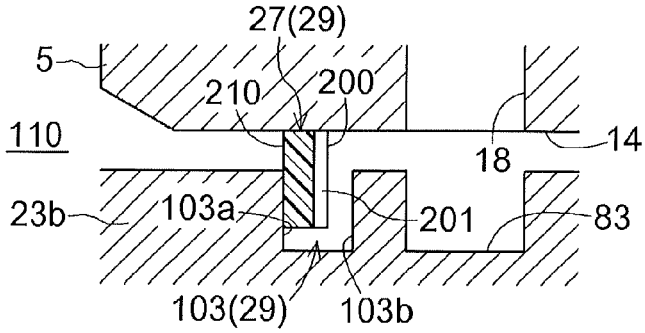
FIG. 4 is a view illustrating an example where air pressure of a retarded angle control groove is higher than air pressure of an outside space.
Figure 5:
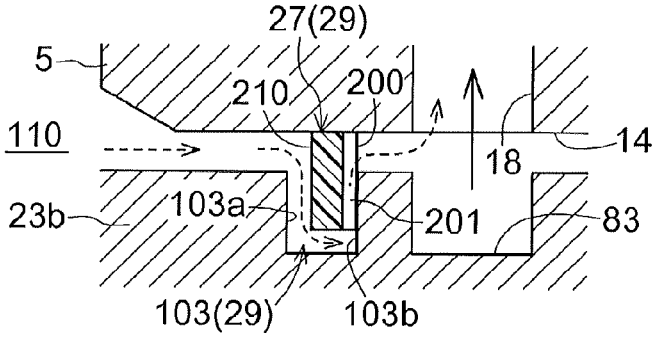
FIG. 5 is a view illustrating an example where the air pressure of the retarded angle control groove is lower than the air pressure of the outside space.

Accordingly, in a case where the pressure of the retarded angle control groove 83 is lower than the air pressure of the outside space 110, the axial direction end surface 210 of the seal ring 27 which is at a side of the outside space 110 is in contact with a wall portion 103*a* of the annular groove 103 which faces in the opposite direction to the outside space 110 as illustrated in FIG. 4. Thus, the retarded angle control groove 83 and the outside space 110 may be partitioned from each other. On the other hand, in a case where the pressure of the retarded angle control groove 83 is higher than the pressure of the outside space 110, the axial direction end surface 200 of the seal ring 27 which is at an opposite side to the outside space 110 is in contact with a wall portion 103*b* of the annular groove 103 which faces in the direction of the outside space 110 as illustrated in FIG. 5. Thus, also in this case, the retarded angle control groove 83 and the outside space 110 are allowed to be partitioned from each other. In addition, in this case, air is introduced from the outside space 110 via the radial direction groove 201 to the retarded angle control groove 83 as indicated with the dotted lines in FIG. 5. Consequently, a state where the retarded angle control groove 83 is in negative pressure is solved or eliminated quickly, and thus the relative rotational phase is moved to the most retarded angle-side. As a result, the variable valve timing control apparatus 100 is operated stably. Each of the wall portion 103*a* and the wall portion 103*b* extends in a direction that is orthogonal to the axis X. The annular groove 103 is defined by the wall portions 103*a* and 103*b*, and the outer circumferential surface of the spider 23*b*.

As described above, according to the variable valve timing control apparatus 100 of this embodiment, atmospheric air is introduced via the radial direction groove 201 of the seal ring 27 to the retarded angle control groove 83 in a case where the working fluid is not supplied smoothly to the retarded angle chamber 6*b* and the pressure of the retarded angle control groove 83 is lower than the air pressure of the outside space 110. Thus, even in a configuration where imbalance exists between a flow path resistance of the advanced angle control groove 82 and a flow path resistance of the retarded angle control groove 83, the negative pressure state of the retarded angle control groove 83 is restricted from continuing for a long time, and therefore the relative rotational phase of the outer rotor 3 and the inner rotor 5 relative to each other may be moved easily and quickly to the desired or intended relative phase. Consequently, even at the start-up of the engine E, the variable valve timing control apparatus 100 is operated stably, and as a result, a desired or intended operation may be performed relative to the engine E.

Figure 6:
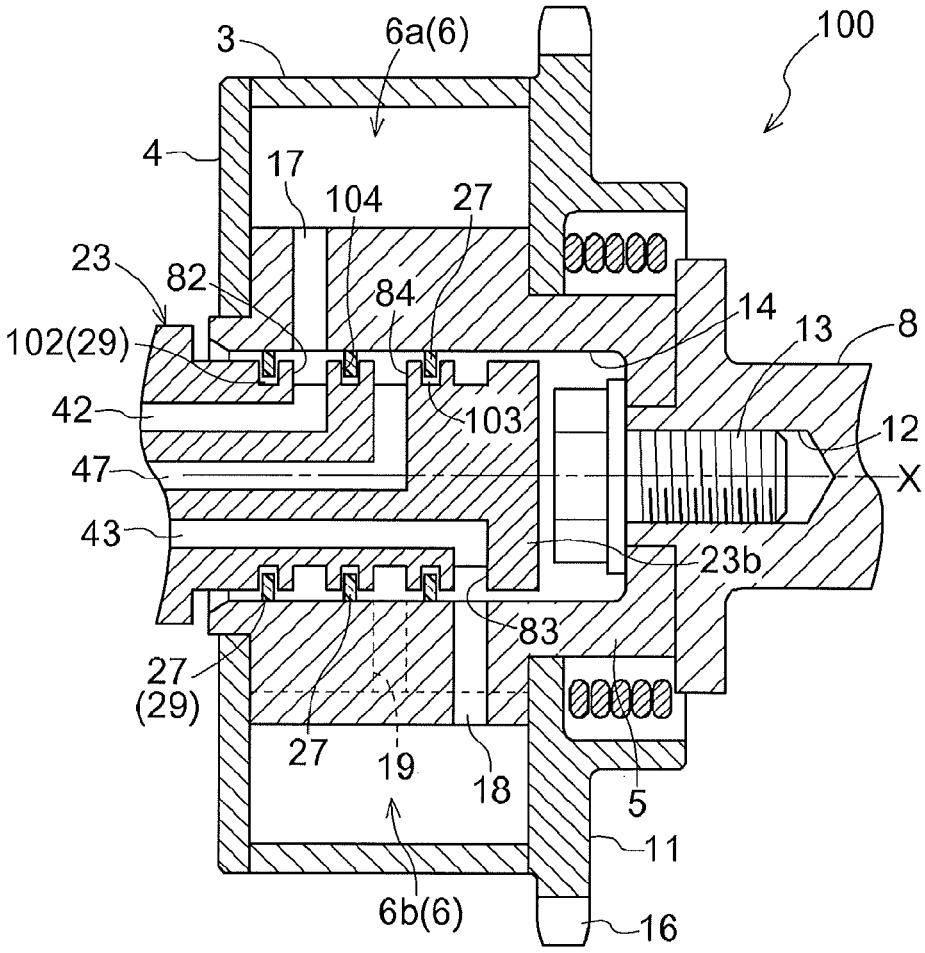
FIG. 6 is a cross-sectional view of a variable valve timing control apparatus according to another embodiment disclosed here.

Another embodiment of this disclosure will be explained hereunder. In the aforementioned embodiment, it is described that the retarded angle control groove 83 is partitioned from the outside space 110 by means of the seal mechanism 29. However, a scope of application of this disclosure is not limited thereto. A configuration where the advanced angle control groove 82 is partitioned from the outside space 110 by means of the seal mechanism 29 may be applied. The variable valve timing control apparatus 100 including such configuration is illustrated in FIG. 6. In this case, the seal mechanism 29 corresponds to the annular groove 102 and the seal ring 27 arranged at the annular groove 102. Even in this case, the working fluid is supplied to the advanced angle chamber 6*a* having the fluid communication with the advanced angle control groove 82, and the relative rotational phase is moved quickly to a most advanced angle-side. As a result, the variable valve timing control apparatus 100 is operated stably.

In the aforementioned embodiment, it is described that the annular grooves 102, 103 and 104 are provided at the outer circumferential surface of the spider 23*b*. However, a scope of application of this disclosure is not limited thereto. The annular grooves 102, 103 and 104 may be provided at the inner circumferential surface of the recessed portion 14. The annular grooves 102, 103 and 104 may be provided at both the inner circumferential surface of the recessed portion 14 and the outer circumferential surface of the spider 23*b*.

In the aforementioned embodiment, it is described that the radial direction groove 201 is provided at the axial direction end surface 200 of the seal ring 27 which faces in the opposite direction to the outside space 110. However, a scope of application of this disclosure is not limited thereto. A configuration, where a communication hole 203 is provided so that the axial direction end surface 210 of the seal ring 27 which is at a side of the outside space 110 and the axial direction end surface 200 of the seal ring 27 which faces in the opposite direction to the outside space 110 are in fluid communication with each other, may be applied.

Figure 7:
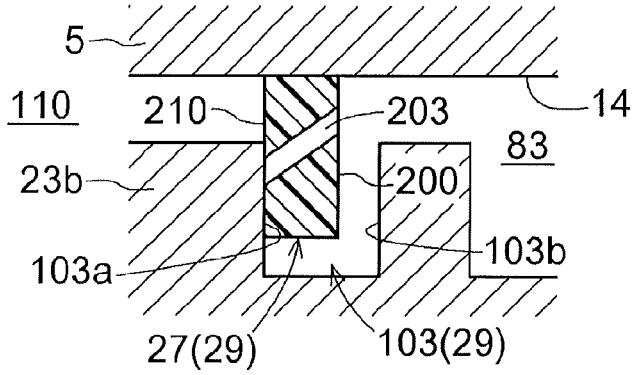
FIG. 7 is a view illustrating an example where a seal ring according to the another embodiment is applied.
Figure 8:
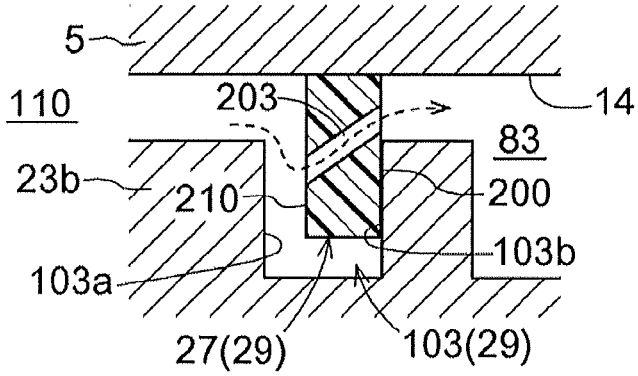
FIG. 8 is a view illustrating the example where the seal ring according to the another embodiment is applied.

The seal ring 27 including such configuration is illustrated in FIGS. 7 and 8. As illustrated in FIGS. 7 and 8, an opening of the communication hole 203, the opening which is formed at the axial direction end surface 210, is provided in a manner that a distance from the inner circumferential surface of the recessed portion 14 to the opening at the axial direction end surface 210 is longer than a distance between the inner circumferential surface of the recessed portion 14 and the outer circumferential surface of the spider 23*b*. An opening of the communication hole 203, the opening which is formed at the axial direction end surface 200, is provided in a manner that a distance from the inner circumferential surface of the recessed portion 14 to the opening at the axial direction end surface 200 is shorter than the distance between the inner circumferential surface of the recessed portion 14 and the outer circumferential surface of the spider 23*b*. Because of this configuration, the axial direction end surface 210 of the seal ring 27 which is at the side of the outside space 110 is in contact with the wall portion 103*a* of the annular groove 103 which faces in the opposite direction to the outside space 110 as illustrated in FIG. 7 in a case where the pressure of the retarded angle control groove 83 is higher than the air pressure of the outside space 110. Accordingly, the opening of the communication hole 203, the opening which is formed at the axial direction end surface 210, is closed, and thus the retarded angle control groove 83 is partitioned from the outside space 110. On the other hand, the axial direction end surface 200 of the seal ring 27 which is at the opposite side to the outside space 110 is in contact with the wall portion 103*b* of the annular groove 103 which faces in the direction of the outside space 110 as illustrated in FIG. 8 in a case where the pressure of the retarded angle control groove 83 is lower than the air pressure of the outside space 110. Accordingly, also in this case, the retarded angle control groove 83 is partitioned from the outside space 110. In addition, in this case, the opening of the communication hole 203, the opening which is formed at the axial direction end surface 200, is opened and thus the air is introduced from the outside space 110 via the communication hole 203 to the retarded angle control groove 83 as indicated with the dotted lines in FIG. 8. Consequently, the negative pressure state of the retarded angle control groove 83 is solved or eliminated quickly, and thus the relative rotational phase is moved to the most retarded angle-side. As a result, the variable valve timing control apparatus 100 is operated stably.

In the aforementioned embodiment, it is described that the radial direction groove 201 is provided at the axial direction end surface 200 of the seal ring 27 which faces in the opposite direction to the outside space 110. However, a scope of application of this disclosure is not limited thereto. A configuration where the radial direction groove 201 is provided at the wall portion 103*b* of the annular groove 103 which faces in the direction of the outside space 110 may be applied.

Figure 9:
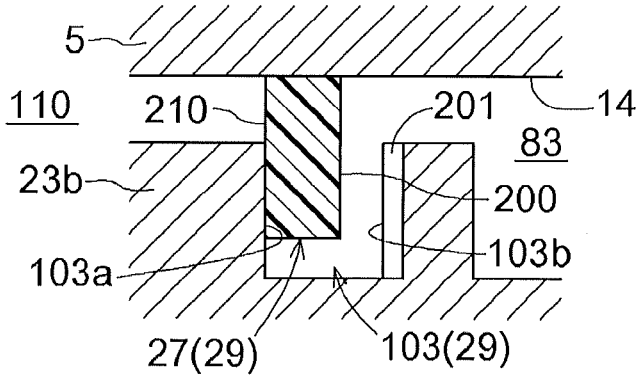
FIG. 9 is a view illustrating a radial direction groove according to the another embodiment.
Figure 10:
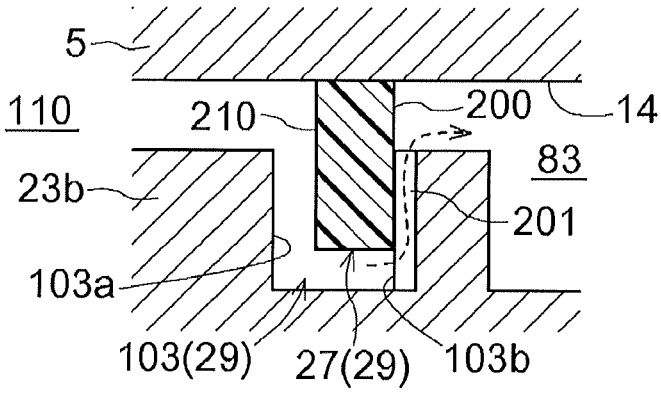
FIG. 10 is a view illustrating the radial direction groove according to the another embodiment.

The variable valve timing control apparatus 100 including such configuration is illustrated in FIGS. 9 and 10. In this case, the axial direction end surface 210 of the seal ring 27 which is at the side of the outside space 110 is in contact with the wall portion 103*a* of the annular groove 103 which faces in the opposite direction to the outside space 110 as illustrated in FIG. 9 in a case where the pressure of the retarded angle control groove 83 is higher than the air pressure of the outside space 110. Thus, the retarded angle control groove 83 and the outside space 110 may be partitioned from each other. On the other hand, the axial direction end surface 200 of the seal ring 27 which is at the opposite side to the outside space 110 is in contact with the wall portion 103*b* of the annular groove 103 which faces the outside space 110 as illustrated in FIG. 10 in a case where the pressure of the retarded angle control groove 83 is lower than the air pressure of the outside space 110. Thus, also in this case, the retarded angle control groove 83 and the outside space 110 may be partitioned or separated from each other. Further, in this case, the air is introduced from the outside space 110 via the radial direction groove 201 to the retarded angle control groove 83 as indicated with the dotted lines in FIG. 10. Consequently, the state where the retarded angle control groove 83 is in negative pressure is solved or eliminated quickly, and thus the relative rotational phase is moved to the most retarded angle-side. As a result, the variable valve timing control apparatus 100 is operated stably.

Also in this configuration, the annular grooves 102, 103 and 104 may be provided at the inner circumferential surface of the recessed portion 14. Alternatively, the annular grooves 102, 103 and 104 may be provided at both the inner circumferential surface of the recessed portion 14 and the outer circumferential surface of the spider 23*b*.

In the aforementioned embodiment, it is described that the radial direction groove 201 is provided at the axial direction end surface 200 of the seal ring 27 which faces in the opposite direction to the outside space 110. However, a scope of application of this disclosure is not limited thereto. The radial direction groove 201 may be provided at the axial direction end surface 200 of the seal ring 27 which faces in the opposite direction to the outside space 110 and also at the wall portion 103*b* of the annular groove 103 which faces in the direction of the outside space 110. Accordingly, the number of the radial direction grooves 201 increases, and thus the state where the retarded angle control groove 83 is in the negative pressure is solved or eliminated even more quickly.

In the aforementioned embodiment, it is illustrated that four of the radial direction grooves 201 are arranged in a circumferential direction of the seal ring 27. However, a scope of application of this disclosure is not limited thereto. That is, less than four of the radial direction grooves 201 may be provided or five or more of the radial direction grooves 201 may be provided.

In the aforementioned embodiment, the example is explained where the variable valve timing control apparatus 100 controls the timing of the intake valve 72 of the combustion chamber 73. However, a scope of application of this disclosure is not limited thereto. The variable valve timing control apparatus 100 may be configured to control a timing of an exhaust valve of the combustion chamber 73 or to control the timings of both the intake valve and the exhaust valve of the combustion chamber 73.

The aforementioned embodiments may be applied to a variable valve timing control apparatus for controlling a relative rotational phase of a driven-side rotating member rotating integrally with a cam shaft of an internal combustion engine relative to a driving-side rotating member rotating synchronously with a crank shaft of an internal combustion engine.

According to the aforementioned embodiments, the variable valve timing control apparatus 100 includes the outer rotor 3 rotating synchronously with the crank shaft 71 of the engine E, the inner rotor 5 rotating integrally with the cam shaft 8 of the engine E and being rotatable relative to the outer rotor 3, the relative rotation angle control valve 124 operating for switching the supply and the discharge of the working fluid in the selective manner relative to the advanced angle chamber 6*a* and the retarded angle chamber 6*b* which are provided between the outer rotor 3 and the inner rotor 5, the advanced angle-side oil passage 42 providing the fluid communication between the relative rotation angle control valve 124 and the advanced angle chamber 6*a*, the retarded angle-side oil passage 43 providing the fluid communication between the relative rotation angle control valve 124 and the retarded angle chamber 6*b*, the spider 23*b* arranged coaxially with the cam shaft 8 and provided with the advanced angle control groove 82 and the retarded angle control groove 83 which is different from the advanced angle control groove 82, a part of the advanced angle-side oil passage 42 functioning as the advanced angle control groove 82, a part of the retarded angle-side oil passage 43 functioning as the retarded angle control groove 83, the seal mechanism 29 partitioning between at least one of the advanced angle control groove 82 and the retarded angle control groove 83, and the outside space 110, and the seal mechanism 29 allowing the air to come in the at least one of the advanced angle control groove 82 and the retarded angle control groove 83 in a case where the pressure inside the at least the one of the advanced angle control groove 82 and the retarded angle control groove 83 is lower than the air pressure of the outside space 110.

According to the above-described configuration, in a case where it is difficult to supply the working fluid smoothly to one of the advanced angle chamber 6*a* and the retarded angle chamber 6*b*, and where the pressure of the one of the advanced angle control groove 82 and the retarded angle control groove 83 is lower than the air pressure of the outside space 110, the atmospheric air may be introduced via the seal mechanism 29 to the one of the advanced angle control groove 82 and the retarded angle control groove 83 in which the air pressure is lower than the air pressure of the outside space 110. Thus, even in the configuration where the imbalance exists between the flow path resistance at the supply path and the flow path resistance at the discharge path, the negative pressure state of the advanced angle control groove 82 and the retarded angle control groove 83 is restricted from continuing for a long time, and therefore the relative rotational phase of the outer rotor 3 and the inner rotor 5 relative to each other is likely to be moved quickly to the desired or intended relative phase. Consequently, even at the start-up of the engine E, the variable valve timing control apparatus 100 is operated stably, and as a result, the desired or intended operation may be performed relative to the engine E.

According to the aforementioned embodiments, the seal mechanism 29 includes the annular groove 102, 103 provided at least one of the outer circumferential surface of the spider 23*b* and the inner circumferential surface of the inner rotor 5, the seal mechanism 29 includes the seal ring 27 at least part of which is fitted in the annular groove 102, 103, and the seal ring 27 includes the radial direction groove 201 provided at the axial direction end surface 200 of the seal ring 27 and extending in the radial direction of the seal ring 27, the axial direction end surface 200 faces in the opposite direction to the outside space 110.

According to the above-described configuration, the atmospheric air may be introduced, via the radial direction groove 201 provided at the seal ring 27, to one of the advanced angle control groove 82 and to the retarded angle control groove 83 of which air pressure is lower than the air pressure of the outside space 110. Thus, the negative pressure state of the advanced angle control groove 82 and the retarded angle control groove 83 is solved or eliminated quickly. Consequently, the variable valve timing control apparatus 100 is operated stably even at the start-up of the engine E.

According to the aforementioned embodiments, the seal mechanism 29 includes the annular groove 102, 103 provided at at least one of the outer circumferential surface of the spider 23*b* and the inner circumferential surface of the inner rotor 5, the seal mechanism 29 includes the seal ring 27 at least part of which is fitted in the annular groove 102, 103, the spider 23*b* includes the wall portion 103*b* facing in the direction of the outside space 110, and the wall portion 103*b* is provided with the radial direction groove 201 extending in the radial direction of the spider 23*b*.

According to the above-described configuration, the atmospheric air is introduced to one of the advanced angle control groove 82 and the retarded angle control groove 83 via the radial direction groove 201 provided at the wall portion 103*b* before the air pressure of the one of the advanced angle control groove 82 and the retarded angle control groove 83 becomes lower than the air pressure of the outside space 110. Thus, the negative pressure state of the advanced angle control groove 82 and the retarded angle control groove 83 is solved or eliminated quickly. Consequently, the variable valve timing control apparatus 100 is operated stably even at the start-up of the engine E.

According to the aforementioned embodiments, the seal ring 27 includes the communication hole 203 providing the fluid communication between the axial direction end surface 210 and the axial direction end surface 200 of the seal ring 27, the axial direction end surface 210 faces in the direction of the outside space 110 and the axial direction end surface 200 faces in the opposite direction to the outside space 110.

According to the above-described configuration, the atmospheric air is introduced to one of the advanced angle control groove 82 and the retarded angle control groove 83 of which air pressure is lower than the air pressure of the outside space 110 via the communication hole 203 provided at the seal ring 27. Thus, the negative pressure state of the advanced angle control groove 82 and the retarded angle control groove 83 is solved or eliminated quickly. Consequently, the variable valve timing control apparatus 100 is operated stably even at the start-up of the engine E.

According to the aforementioned embodiments, the variable valve timing control apparatus 100 includes the outer rotor 3 rotating synchronously with the crank shaft 71 of the engine E, the inner rotor 5 rotating integrally with the cam shaft 8 of the engine E and being rotatable relative to the outer rotor 3, the relative rotation angle control valve 124 operating for switching the supply and the discharge of the working fluid in a selective manner relative to the advanced angle chamber 6*a* and the retarded angle chamber 6*b* which are provided between the outer rotor 3 and the inner rotor 5, the advanced angle-side oil passage 42 providing the fluid communication between the relative rotation angle control valve 124 and the advanced angle chamber 6*a*, the retarded angle-side oil passage 43 providing the fluid communication between the relative rotation angle control valve 124 and the retarded angle chamber 6*b*, the spider 23*b* arranged coaxially with the cam shaft 8, and provided with the advanced angle control groove 82 and the retarded angle control groove 83 which is different from the advanced angle control groove 82, the spider 23*b* provided with the plurality of wall portions 103*a*, 103*b* each extending in the direction that is orthogonal to the axis X of the cam shaft 8, a part of the advanced angle-side oil passage 42 functioning as the advanced angle control groove 82 and a part of the retarded angle-side oil passage 43 functioning as the retarded angle control groove 83, the seal mechanism 29 including the annular groove 102, 103 defined by the plurality of wall portions 103*a*, 103*b* and an outer circumferential surface of the spider 23*b*, the seal mechanism 29 including the seal ring 27 at least part of which is fitted in the annular groove 102, 103, the seal mechanism 29 partitioning between at least one of the advanced angle control groove 82 and the retarded angle control groove 83, and the outside space 110, the seal ring 27 including the axial direction end surface 200 facing in the opposite direction to the outside space 110 and the axial direction end surface 210 facing in the direction of the outside space 110, and the axial direction end surface 200 of the seal ring 27 coming in contact with one of the plurality of wall portions 103*a*, 103*b* which faces in the direction of the outside space 110 in a case where pressure of the at least one of the advanced angle control groove 82 and the retarded angle control groove 83 is lower than the air pressure of the outside space 110, the axial direction end surface 210 of the seal ring 27 coming in contact with one of the plurality of wall portions 103*a*, 103*b* which faces in the opposite direction to the outside space 110 in a case where the pressure of the at least one of the advanced angle control groove 82 and the retarded angle control groove 83 is higher than the air pressure of the outside space 110.

The principles, preferred embodiments and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A variable valve timing control apparatus, comprising:

a driving-side rotating member rotating synchronously with a crank shaft of an internal combustion engine;

a driven-side rotating member rotating integrally with a cam shaft of the internal combustion engine and being rotatable relative to the driving-side rotating member;

a control valve operating for switching supply and discharge of a working fluid in a selective manner relative to an advanced angle chamber and a retarded angle chamber which are provided between the driving-side rotating member and the driven-side rotating member;

an advanced angle-side oil passage providing fluid communication between the control valve and the advanced angle chamber;

a retarded angle-side oil passage providing fluid communication between the control valve and the retarded angle chamber;

a spider arranged coaxially with the cam shaft and provided with a first oil passage and a second oil passage which is different from the first oil passage, a part of the advanced angle-side oil passage functioning as the first oil passage, a part of the retarded angle-side oil passage functioning as the second oil passage;

a seal mechanism partitioning between at least one of the first oil passage and the second oil passage, and an outside space; and the seal mechanism allowing air to come in said at least one of the first oil passage and the second oil passage in a case where pressure inside said at least the one of the first oil passage and the second oil passage is lower than air pressure of the outside space.

2. The variable valve timing control apparatus according to claim 1, wherein the seal mechanism includes an annular groove provided at at least one of an outer circumferential surface of the spider and an inner circumferential surface of the driven-side rotating member, the seal mechanism includes a seal ring at least part of which is fitted in the annular groove, and the seal ring includes a radial direction groove provided at a first end surface of the seal ring and extending in a radial direction of the seal ring, the first end surface faces in an opposite direction to the outside space.

3. The variable valve timing control apparatus according to claim 2, wherein the seal ring includes a communication hole providing fluid communication between a second end surface of the seal ring and the first end surface of the seal ring, the second end surface faces in the direction of the outside space and the first end surface faces in the opposite direction to the outside space.

4. The variable valve timing control apparatus according to claim 1, wherein the seal mechanism includes an annular groove provided at at least one of an outer circumferential surface of the spider and an inner circumferential surface of the driven-side rotating member, the seal mechanism includes a seal ring at least part of which is fitted in the annular groove, the spider includes a wall portion facing in a direction of the outside space, and the wall portion is provided with a radial direction groove extending in a radial direction of the spider.

5. The variable valve timing control apparatus according to claim 4, wherein the seal ring includes a communication hole providing fluid communication between a second end surface of the seal ring and the first end surface of the seal ring, the second end surface faces in the direction of the outside space and the first end surface faces opposite to the outside space.

6. A variable valve timing control apparatus, comprising:

a driving-side rotating member rotating synchronously with a crank shaft of an internal combustion engine;

an driven-side rotating member rotating integrally with a cam shaft of the internal combustion engine and being rotatable relative to the driving-side rotating member;

a control valve operating for switching supply and discharge of a working fluid in a selective manner relative to an advanced angle chamber and a retarded angle chamber which are provided between the driving-side rotating member and the driven-side rotating member;

an advanced angle-side oil passage providing fluid communication between the control valve and the advanced angle chamber;

a retarded angle-side oil passage providing fluid communication between the control valve and the retarded angle chamber;

a spider arranged coaxially with the cam shaft, and provided with a first oil passage and a second oil passage which is different from the first oil passage, the spider provided with a plurality of wall portions each extending in a direction that is orthogonal to an axis of the cam shaft, a part of the advanced angle-side oil passage functioning as the first oil passage and a part of the retarded angle-side oil passage functioning as the second oil passage;

a seal mechanism including an annular groove defined by the plurality of wall portions and an outer circumferential surface of the spider, the seal mechanism including a seal ring at least part of which is fitted in the annular groove, the seal mechanism partitioning between at least one of the first oil passage and the second oil passage, and an outside space;

the seal ring including a first end surface facing in an opposite direction to the outside space and a second end surface facing in a direction of the outside space; and the first end surface of the seal ring coming in contact with one of the plurality of wall portions which faces in the direction of the outside space in a case where pressure of said at least one of the first oil passage and the second oil passage is lower than air pressure of the outside space, the second end surface of the seal ring coming in contact with one of the plurality of wall portions which faces in the opposite direction to the outside space in a case where the pressure of said at least one of the first oil passage and the second oil passage is higher than the air pressure of the outside space.

* * * * *